US008087206B1

(12) United States Patent
Worley et al.

(10) Patent No.: US 8,087,206 B1
(45) **Date of Patent: *Jan. 3, 2012**

(54) ROOFING TILE SYSTEM

(76) Inventors: Ronald J. Worley, Tequesta, FL (US); Harry Robinson, Loxahatchee, FL (US)

( * ) Notice: Subject to any disclaimer, the term of this patent is extended or adjusted under 35 U.S.C. 154(b) by 279 days.

This patent is subject to a terminal disclaimer.

(21) Appl. No.: 12/577,135

(22) Filed: Oct. 9, 2009

Related U.S. Application Data

(63) Continuation-in-part of application No. 12/389,329, filed on Feb. 19, 2009.

(51) Int. Cl.
*E04D 1/00* (2006.01)

(52) U.S. Cl. ..... 52/549; 52/520; 52/551

(58) Field of Classification Search ..... 52/518, 52/520, 543, 546, 549, 551, 552
See application file for complete search history.

(56) References Cited

U.S. PATENT DOCUMENTS

| | | | | | |
|---|---|---|---|---|---|
| 3,835,609 | A * | 9/1974 | Oscar | 52/478 |
| 4,182,090 | A * | 1/1980 | Aarons | 52/489.1 |
| 4,314,433 | A * | 2/1982 | Hulcombe | 52/521 |
| 4,544,595 | A * | 10/1985 | Tomason | 428/116 |
| 4,554,773 | A * | 11/1985 | Conley | 52/521 |
| 4,599,828 | A | 7/1986 | Ishikura | |
| 4,729,202 | A | 3/1988 | Ferland | |
| 4,765,113 | A | 8/1988 | Jong | |
| 4,787,190 | A * | 11/1988 | Papsdorf | 52/553 |
| 4,914,885 | A | 4/1990 | Baker et al. | |
| 5,048,255 | A * | 9/1991 | Gonzales | 52/533 |
| 5,337,529 | A * | 8/1994 | Lutin et al. | 52/389 |
| 5,722,212 | A * | 3/1998 | Struve et al. | 52/712 |
| 6,557,315 | B2 * | 5/2003 | Tremblay | 52/552 |
| 2007/0094948 | A1 | 5/2007 | Osborne et al. | |

FOREIGN PATENT DOCUMENTS

| | | |
|---|---|---|
| EP | 0396380 | 11/1990 |
| EP | 0694658 | 1/1996 |
| GB | 2202245 A * | 9/1988 |
| WO | WO 9322523 A1 * | 11/1993 |

* cited by examiner

*Primary Examiner* — Brian Glessner
*Assistant Examiner* — Adriana Figueroa
(74) *Attorney, Agent, or Firm* — Gold & Rizvi, P.A.; Glenn E. Gold; H. John Rizvi

(57) ABSTRACT

A roofing tile system provides a secure covering for a building roof and comprises a plurality of rigid tiles attached on a pitched roofing substrate in multiple interlocked rows of tiles. Each tile includes a protected end partially overlapped by another tile in an adjacent row, and an exposed end. The protected end of each tile includes at least one attachment hole and at least one anchoring panel. The exposed end of each tile includes at least one interlock hole. Primary roofing screws are provided for driving through attachment holes and into the substrate for attaching tiles in side-by-side relation to form multiple rows. Interlock fasteners are provided for driving through interlock holes and into the interlock panel of a partially overlapped tile in an adjacent row, for interlocking the exposed ends of the roofing tiles with anchoring panels in adjacent tiles.

21 Claims, 17 Drawing Sheets

ROOFING TILE SYSTEM

CROSS-REFERENCE TO RELATED APPLICATION

This application is a Continuation-In-Part of and claiming the benefit from U.S. Non-Provisional patent application Ser. No. 12/389,329, filed on Feb. 19, 2009, which is incorporated herein in its entirety.

BACKGROUND OF THE INVENTION

1. Field of the Invention

The invention generally relates to roofing tiles and more particularly to a system including a plurality of partially overlapping rows of roofing tiles in side-by-side relation on a pitched roof, with neighboring roofing tiles in adjacent rows interlocked.

2. Description of the Prior Art

A building roof typically includes a layer of rigid material attached to joists or beams to form planar substrates. The roof is made weather tight by the application, on the substrates, of weatherproof material having provisions for positive drainage. A typical arrangement is a pitched roof consisting of one or more sections of planar substrates, pitched at an angle to promote downward run-off from an uppermost edge toward a lowermost edge. Uppermost edges of adjacent sections may meet at a peak defined by the boundary between the sections. Each roof section is typically covered by weatherproof tiles attached in overlapping rows of tiles in side-by-side relation. Each row of tiles overlaps neighboring tiles in the next lower row. Gaps between adjacent side edges of tiles forming a row are usually partially covered by an intermediate portion of a tile in the next row upward. The peak is covered by curved tiles having opposed lower side edges and a higher central ridge, which curved tiles direct draining water downward onto each of the adjacent roof sections.

Roofing tiles may be formed of rigid or flexible material but in either case, it is common practice to attach the tiles by driving a fastener, such as a roofing nail, through the tile, at a location proximate to the uppermost end, and into the substrate. A first row of tiles is attached at the lowermost edge of a roof section, in side-by side relation. A next row of tiles is attached in the same manner partially overlapping the first row and protecting the uppermost end by covering the holes through which the fasteners pass into the substrate. It is necessary to cover the holes so that water leaks will be avoided, when water drains downward over the roofing tiles. The area of each of the roofing tiles proximate to the lower end, is exposed, while the area proximate to the upper end, including the holes, is protected by the next upper row of tiles. The exposed ends of the tiles are not known to be attached by a fastener.

A moderate wind may cause movement of the exposed ends of flexible roofing tiles. The movement is characterized by flexing of the tiles. The flexing movement absorbs the force exerted by the wind and the protected ends of the tiles may or may not transmit appreciable force to the roofing nails holding the tiles in place. Flexible tiles are known to tear from the secured section or break free in sheets when exposed to a strong enough wind. Rigid roofing tiles are typically heavier than flexible tiles and remain stationary in moderate winds. The rigid roofing systems are generally substantially more costly than flexible roofing systems and are expected to have a significantly longer useful life.

In high winds, the exposed ends of rigid roofing tiles are also moved. The tiles do not flex and the movement is transmitted to the area proximate to the protected ends and force is applied to the roofing nails. The nails may become dislodged causing tiles to slide or become free from their position exposing the roof to possible leaks and tile breakage. There is a need for a system, which provides for areas of the tiles proximate to the exposed ends to be attached, thus preventing movement. There is a need for a system including means for interlocking adjacent rows of tiles for a more secure roof.

SUMMARY OF THE INVENTION

The present invention is directed to a roofing tile system including a plurality of tiles configured for attachment in partially overlapping rows of tiles arranged in side-by-side relation on a substrate of a pitched roof. The system includes a plurality of weatherproof tiles, a plurality of standard tile fasteners, and a plurality of interlocking fasteners. Each of the tiles includes a protected end, an exposed end, and two side edges. Each tile is provided with one or more attachment holes proximate to the protected end, for receiving standard tile fasteners. Each of the tiles is provided with one or more anchoring panels, affixed by engagement means, proximate to the protected end, for receiving interlocking fasteners. Each of the tiles is provided with one or more interlock holes, located proximate to the exposed end and positioned to register with one or more of the anchoring panels in a tile in an adjacent overlapped row of tiles.

Standard tile fasteners may be driven through attachment holes, in a first row of tiles, and into the substrate, to attach a first row of tiles, in side-by-side relation. Next, standard tile fasteners may be driven through attachment holes in a second row of tiles and into the substrate to attach a second row of tiles in side-by-side relation partially overlapping said first row of tiles. Interlocking fasteners may be driven through the interlock holes, in the second row of tiles and into the anchoring panels in the first row of tiles, to interlock the first and second rows of tiles. Subsequent rows of tiles may be attached by driving standard tile fasteners through attachment holes and into the substrate and interlocking fasteners may be driven through interlock holes and into anchoring panels in each preceding row of tiles to interlock each row of tiles with the preceding row. The system of the present invention provides means for interlocking the rows of roofing tiles on a section of roofing substrate. The standard tile fasteners may be nails or screws and the interlocking fasteners are preferably screws. The roofing system of the present invention may be installed using conventional fasteners and conventional tools.

An object of the present invention is to provide a roofing tile system, which can be attached on a pitched roof substrate in partially overlapped interlocked rows of tiles in side-by-side relation.

Another object of the present invention to provide a roofing system of interlocked rows of tiles in side-by-side relation, which can be installed in a conventional manner using conventional tools.

It is yet another object of the present invention to provide a roofing tile system of interlocked rows of tiles in side-by-side relation, which is secure in a high wind.

While another object provides a series of ridge roof tiles incorporating an anchoring panel located proximate an overlapping end and a respecting interlock hole located at the opposite end and in registration with the anchoring panel of the overlapped tile.

In yet another object, the roofing tile system is secured to an eve closure via a mechanical fastener.

Another object of the present invention provides a variety of anchoring panel form factor, each providing a different mechanical perimeter facet design for securing the anchoring panel into the roofing tile. The perimeter facet can be of a tongue and groove design, a series of parallel finger webs, a perimeter flange, a perimeter flange incorporating a series of wells or apertures, canted perimeter facet, and the like.

These and other objects, features and advantages of the present invention will become more readily apparent from the attached drawings and the detailed description of the preferred embodiments, which follow.

BRIEF DESCRIPTION OF THE DRAWINGS

The invention will be further understood, by way of example, with reference to the accompanying drawings, in which.

DETAILED DESCRIPTION OF THE PREFERRED EMBODIMENTS

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention.

Figure 1:
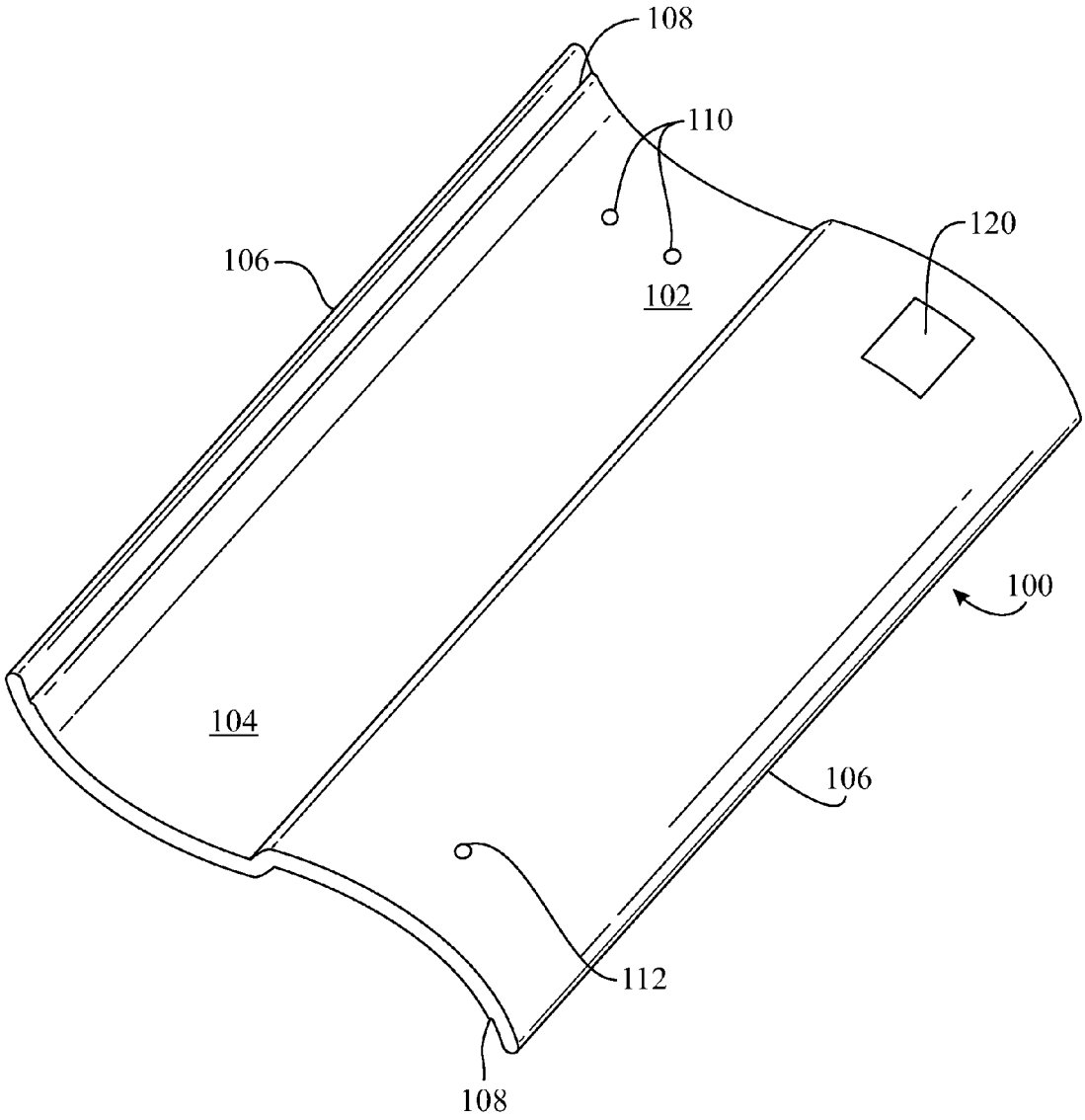
FIG. 1 presents a perspective view of an "S" shaped or double curve roofing tile of the present invention.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
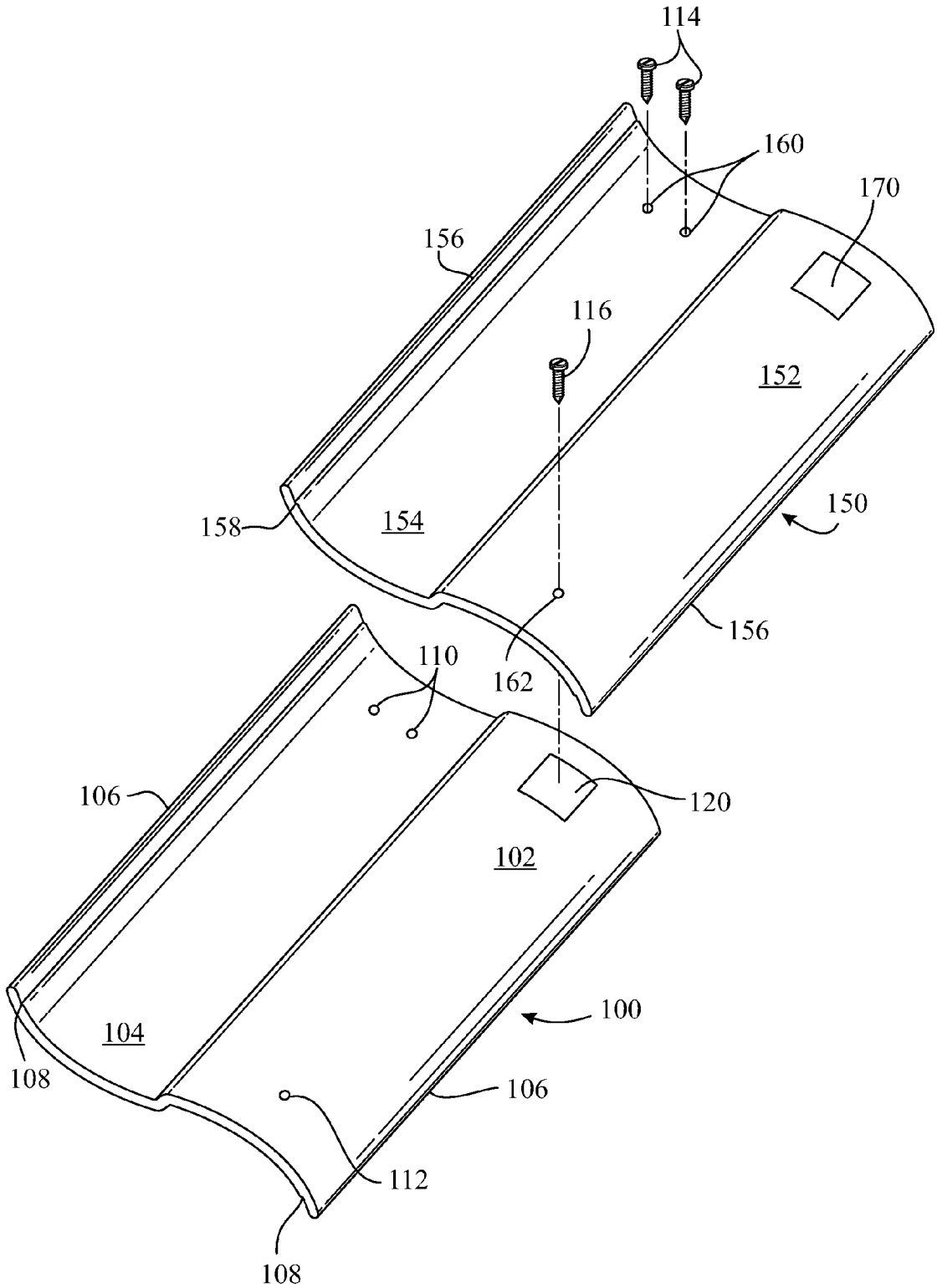
FIG. 2 presents an exploded perspective view of two double curve roofing tiles of the present invention in partial overlapping relation.

Shown throughout the drawings, the present invention is generally directed towards a roofing tile system for installation on a pitched roof, which includes a plurality of roofing tiles in partially overlapped and interlocked rows of tiles in side-by-side relation. The rows of tiles are designed for installation on planar sections of roofing substrate with the understanding that multiple adjacent sections of substrate form the roof structure of a building. The system of the present invention is suitable for weatherproof roofing tiles of varied design. Several tile configurations will be used as exemplary embodiments throughout this application. It is understood the roofing tile system can be applied to all molded tile shapes and sizes. An exemplary first large profile "S" shaped curved tile, more broadly referred to as a double curve tile 100 is shown in FIG. 1. The first double curve tile 100 includes a protected end 102 and an exposed end 104. It is intended that the tiles of the present invention, such as the first double curve tile 100 be installed on a pitched section of roofing substrate such that the protected end 102 is elevated above the exposed end 104 by virtue of the slope of the roofing substrate. The first double curve tile 100 includes two generally parallel side edges 106. The tiles of the present invention may preferably be installed in conventional manner by attaching a first row of tiles, in side-by-side relation, along a lowermost edge of a pitched section of roofing substrate. It is preferred that the side edges 106 of the first double curve tile 100 include a formed lip 108 parallel to the side edges 106 to facilitate alignment of adjacent tiles in side-by-side relation and to provide a partial overlap for maintaining drainage over the upward facing surfaces of the tiles, such as the first double curve tile 100 according to conventional practice. The first double curve tile 100 includes one or more attachment holes 110 proximate to the protected end 102, for attaching the first double curve tile 100 to the substrate. The first double curve tile 100 also includes an anchoring panel 120 and an interlock hole 112. The anchoring panel 120 is spaced apart from the attachment holes 110 and proximate to the protected end 102. The interlock hole 112 is proximate to the exposed end 104. The first double curve tile 100 may be interlocked with a neighboring second double curve tile 150, as shown in FIG. 2. The second double curve tile 150 is a duplicate of the first double curve tile 100 and includes a protected end 152, an exposed end 154, side edges 156, formed lips 158, attachment holes 160, an anchoring panel 170, and an interlock hole 162.

After attaching a first row of tiles, in side-by-side relation along the lowermost boundary of a pitched section of roofing substrate, a second row of tiles is attached, in side-by-side relation. The second double curve tile 150 is intended to be a member of the second row of tiles intended to be attached such that the exposed end 154 of the second double curve tile 150 overlaps the protected end 102 of the first double curve tile 100, a member of the first row. Primary fastening means are provided for driving through the attachment holes 110 and 160 of the first and second double curve tiles 100 and 150, respectively, and into the roofing substrate, for attaching the tiles. Primary fastening means are preferably selected to have characteristics appropriate for securely gripping the roofing substrate. Conventional roofing nails or primary roofing screws 114 are suitable. FIG. 2 shows primary roofing screws 114 in alignment with the attachment holes 160 of the second double curve tile 150, with a dotted line indicating the path for driving through the attachment holes 160. It is to be understood that the first double curve tile 100 is to be attached with primary fastening means driven through the attachment holes 110 in the first double curve tile 100 and into the roofing substrate. Secondary fastening means are provided for interlocking the second double curve tile 150 to the first double curve tile 100. Secondary fastening means are preferably an interlock fastener 116. A interlock fastener 116 is shown in FIG. 2, in alignment with the anchoring panel 120 of the first double curve tile 100 and also with the interlock hole 162 of the second double curve tile 150, which interlock hole 162 is located so as to register with the anchoring panel 120 of the first double curve tile 100, in the partially overlapping relation typical of conventional practice for attaching roofing tiles. The system of the present invention may be adapted for broader roofing tiles by including additional interlock holes in each tile and multiple anchoring panels positioned to register with the interlock holes.

Figure 3:
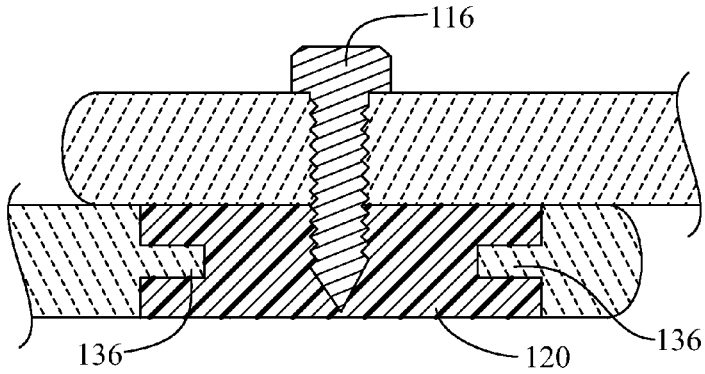
FIG. 3 presents a partial elevation cross-section view of roofing tiles of the present invention in partial overlapping relation.

The interlock fastener 116 is selected to have favorable characteristics for gripping the anchoring panel 120 and also is selected to have a length sufficiently long to firmly grip the anchoring panel 120 but not so long as to allow penetration through the anchoring panel 120, as shown in FIG. 3. Self threading square head drive screws are suitable for interlock fasteners 116 and for convenience, the same screws may serve as primary fastening means; however, conventional roofing nails, which are more economical, are also suitable, as primary fastening means.

Figure 4:
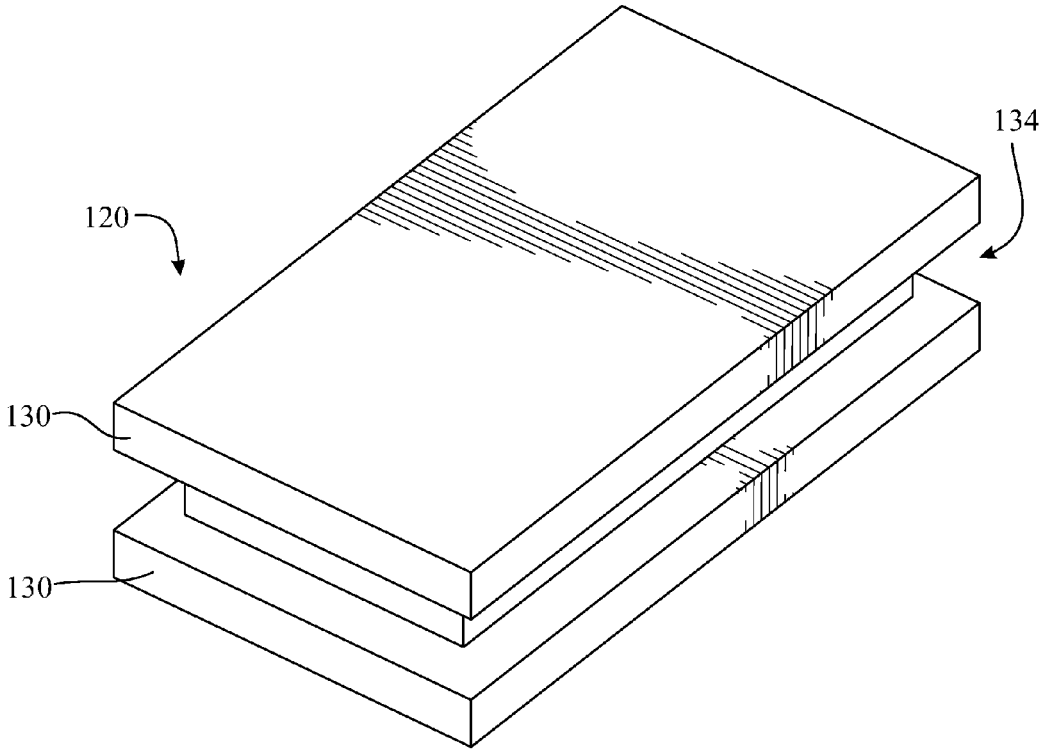
FIG. 4 presents a perspective view of an anchoring panel of the present invention.
Figure 5:
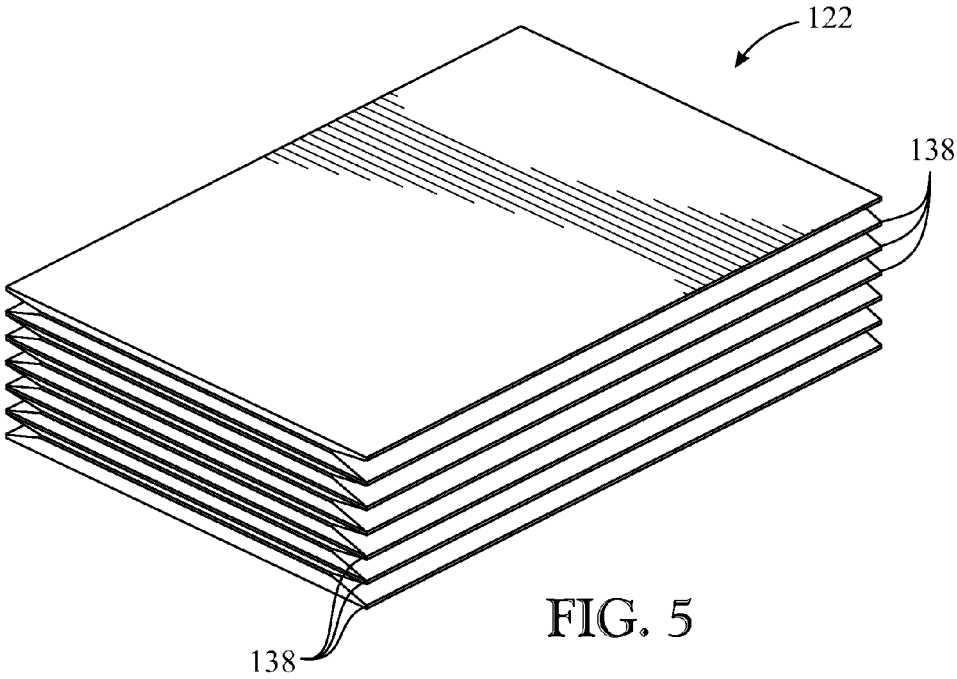
FIG. 5 presents a perspective view of a first alternate embodiment anchoring panel of the present invention.
Figure 6:
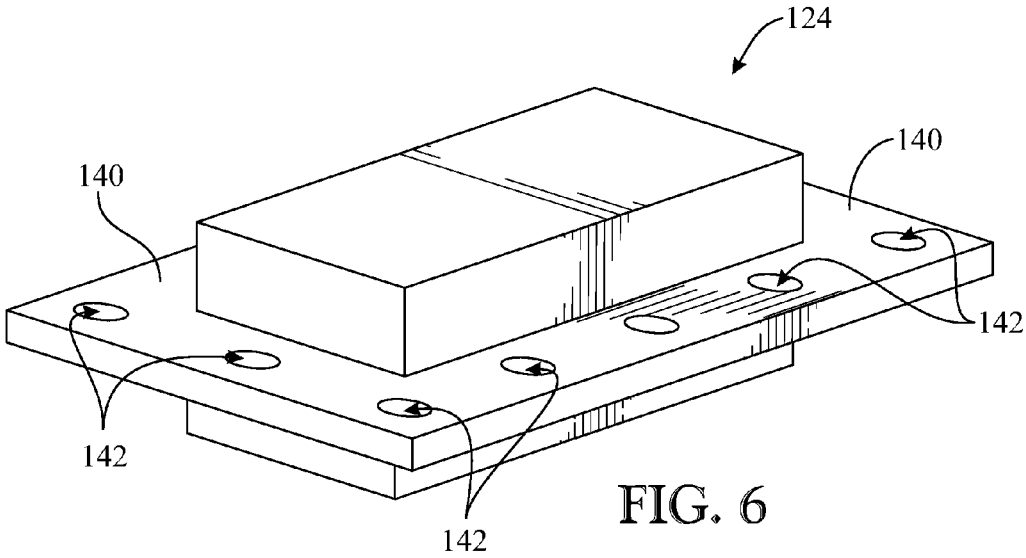
FIG. 6 presents a perspective view of a second alternate embodiment anchoring panel of the present invention.
Figure 7:
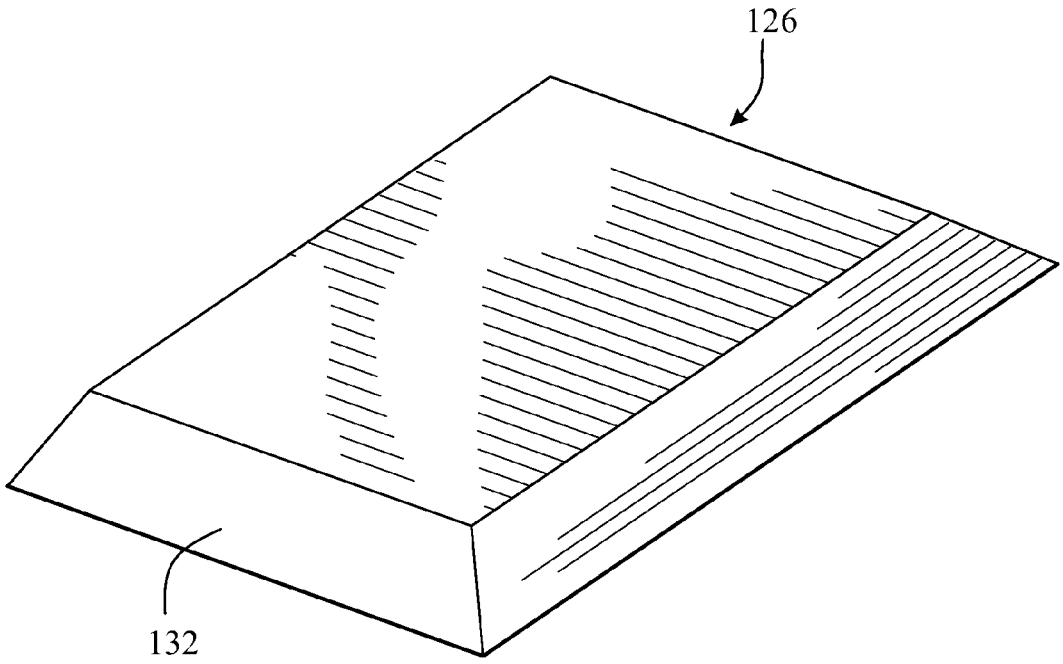
FIG. 7 presents a perspective view of a third alternate embodiment anchoring panel of the present invention.

An exemplary anchoring panel 120, shown in detail in FIG. 4, is retained by engagement means, within an aperture of complementary shape, provided in a roofing tile of the present invention, shown in FIG. 3, such as the double curve tiles 100 and 150 shown in FIGS. 1 and 2. The anchoring panel 120 is a body having a shape and volume selected to be received within the aperture with opposed parallel surfaces configured to lie flush with opposed surfaces of the tile, and a perimeter facet 130 adjacent to an inner aspect of the aperture, as shown in FIG. 3. The opposed surfaces of the anchoring panel 120 are depicted in a rectangular shape but it will be appreciated that other two dimensional shapes would serve as well. The anchoring panel 120 is preferably preformed and subsequently insert molded into the tile 100. The anchoring panel 120 can alternately be formed of compressible and resilient material, which will forcibly expand to exert stabilizing tension on the inner aspect of the aperture. The selected material is also preferably rigid so as to resist flexing as secondary fastening means are driven. Examples of the material include: a plastic material, a composite material, a synthetic material, a copolymer based material, a semi-crystalline polymer based material, a resin based material, Polyoxymethylene, and the like. Engagement means may comprise a tongue and groove arrangement consisting of a groove 134, in the perimeter facet 130 and a complementary tongue 136 formed on the inner aspect of the aperture of the tile, as shown in FIG. 3. Engagement means may include a first alternate anchoring panel 122 as shown in FIG. 5, formed of the same material and having a plurality of parallel finger webs 138 defining a plurality of interstitial valleys for receiving complementary perimeter ridges (not shown) which may be formed on the inner aspect of the aperture of a tile. FIG. 6 shows engagement means on a second alternate anchoring panel 124 having a perimeter flange 140 having a plurality of wells 142 about the flange 140 designed to receive a corresponding plurality of bosses (not shown) formed about a perimeter channel (not shown) on the inner aspect of the aperture of a tile. FIG. 7 shows a third alternate anchoring panel 126 being a body having the shape of a square pyramid base, with a canted perimeter facet 132 and being designed to be retained in a tile by engagement means such as being insert molded or via an adhesive applied between the perimeter facet 132 and a corresponding canted inner aspect of the aperture on the third alternate anchoring panel 126 which may be received into the tapered aperture. It will be appreciated that other similar engagement means may be employed.

Figure 8:
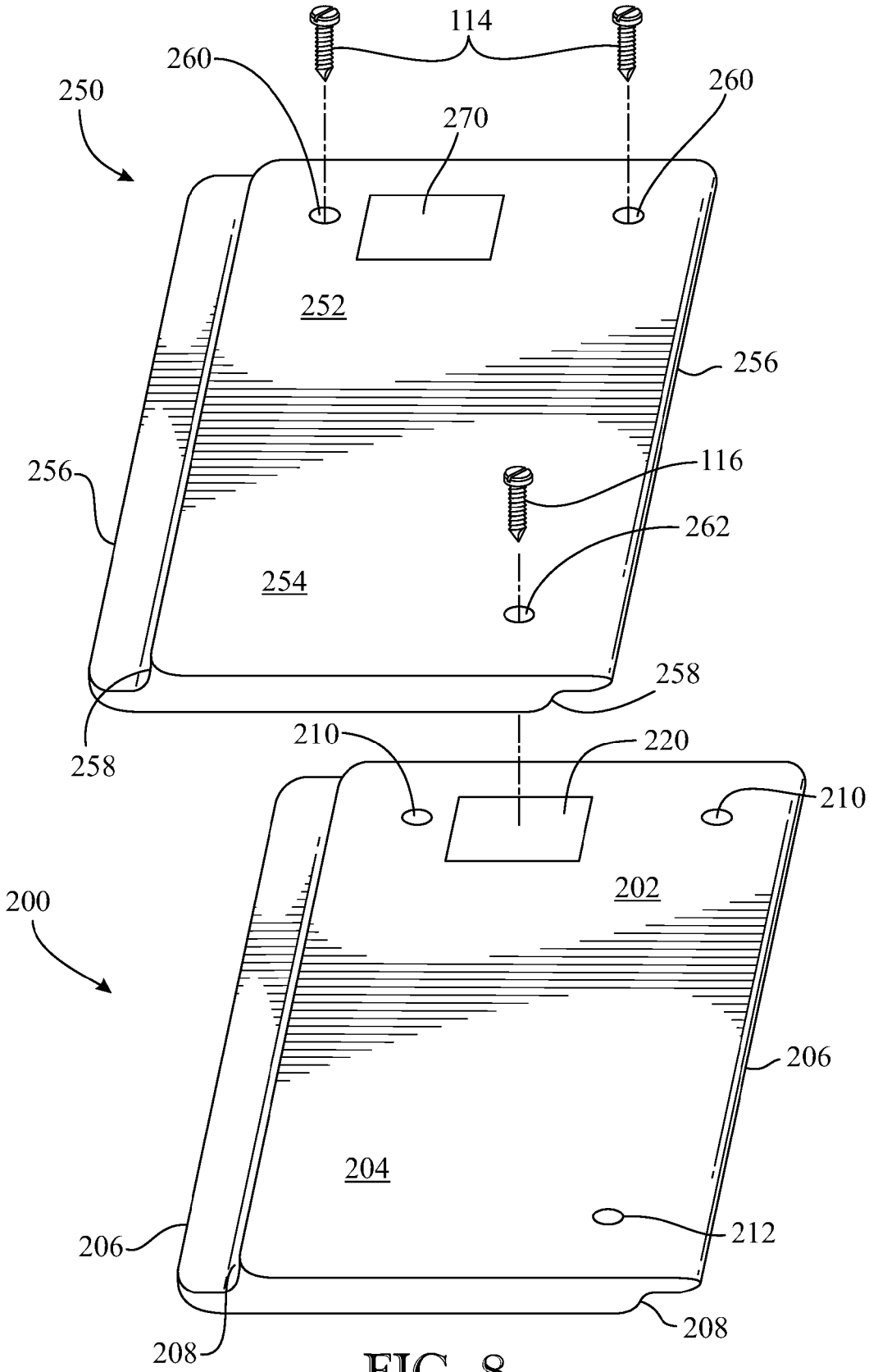
FIG. 8 presents an exploded perspective view of two flat roofing tiles of the present invention in partial overlapping relation.
Figure 9:
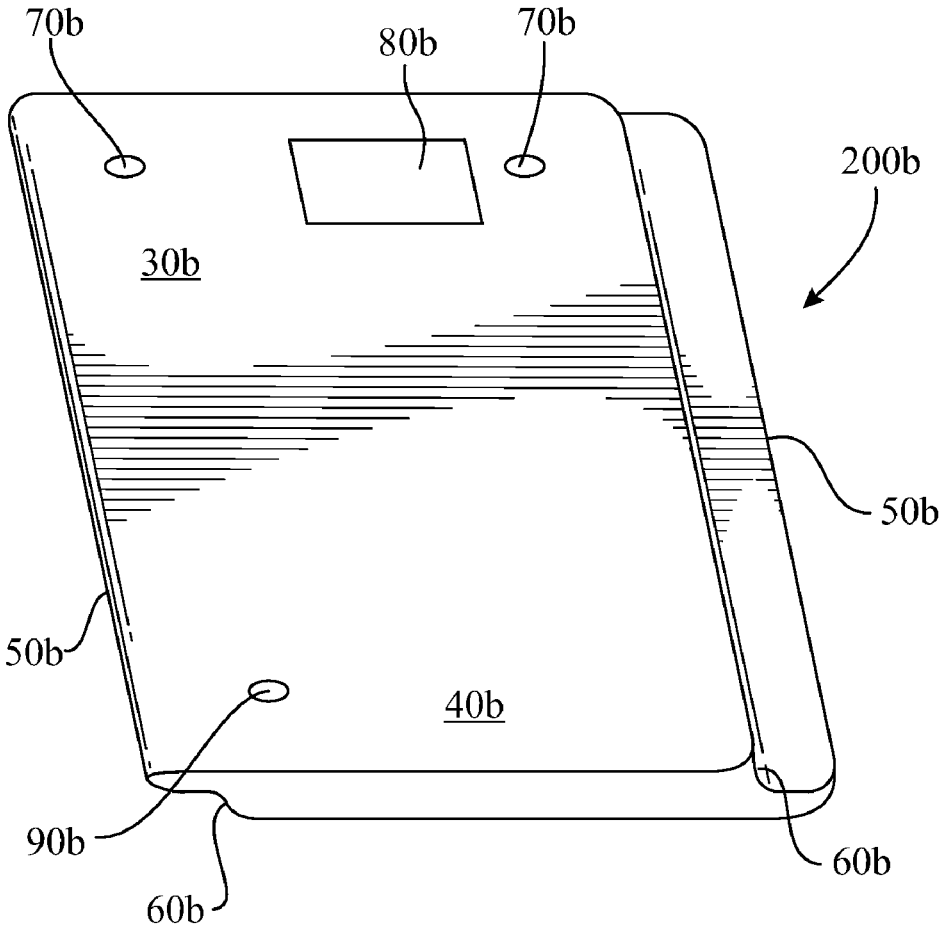
FIG. 9 presents a reverse perspective view of a flat roofing tile of the present invention.

Exemplary first flat roofing tile 200 and second flat roofing tile 250 are shown in FIG. 8. First and second flat roofing tiles 200 and 250 include a protected end 202 and 252, an exposed end 204 and 254, side edges 206 and 256, formed lips 258, attachment holes 210 and 260, an anchoring panel 220 and 270, and an interlock hole 212 and 262. The first flat tile 200 is intended to be a member of a first row of tiles attached to a roofing substrate in side-by-side relation. The second flat tile 250 is intended to be a member of a second row of tiles attached to the roofing substrate in side-by-side relation and partially overlapping the first row. The side edges 206 of the first flat tile 200 and the second flat tile 250 are each provided with a lip 208 to engage adjacent tiles in the row. Primary fastening means, such as primary roofing screws 114 are shown in position for driving through attachment holes 260 in the second flat tile 250 along the path indicated by a dotted line, penetrating the substrate to attach the second flat tile 250. Likewise, the first flat tile 200 is to be attached to the substrate by primary fastening means, such as first roofing screws (not shown). The second flat tile 250 is interlocked with the first flat tile 200 by secondary fastening means, such as an interlock fastener 116 driven through the interlock hole 262 in the second flat tile 250 and into the anchoring panel 220 in the first flat tile 200. It is to be understood that each of the flat tiles forming the second row of tiles are to be interlocked with an adjacent and partially overlapped tile of the first row to interlock the second row tiles with the first row tiles. Successive rows of tiles would be attached to cover the entire section of roofing substrate, with each successive row of tiles interlocked with the preceding partially overlapped row of tiles. FIG. 9 shows a reverse view of the flat tile 200 including a view of one of the opposed surfaces of the anchoring panel 220 lying flush with a reverse surface of the first flat tile 200. For ease of construction, an aperture is formed in the tile, but as an alternative, a recess, sized to receive an anchoring panel, which recess does not communicate with the reverse surface of a tile would also serve. It will be appreciated that the anchoring panels shown in roofing or ridge tiles, in FIGS. 1, 2, 8, 9, 10, 11, and 12 may be any of the embodiments of anchoring panel disclosed and claimed herein.

Figure 10:
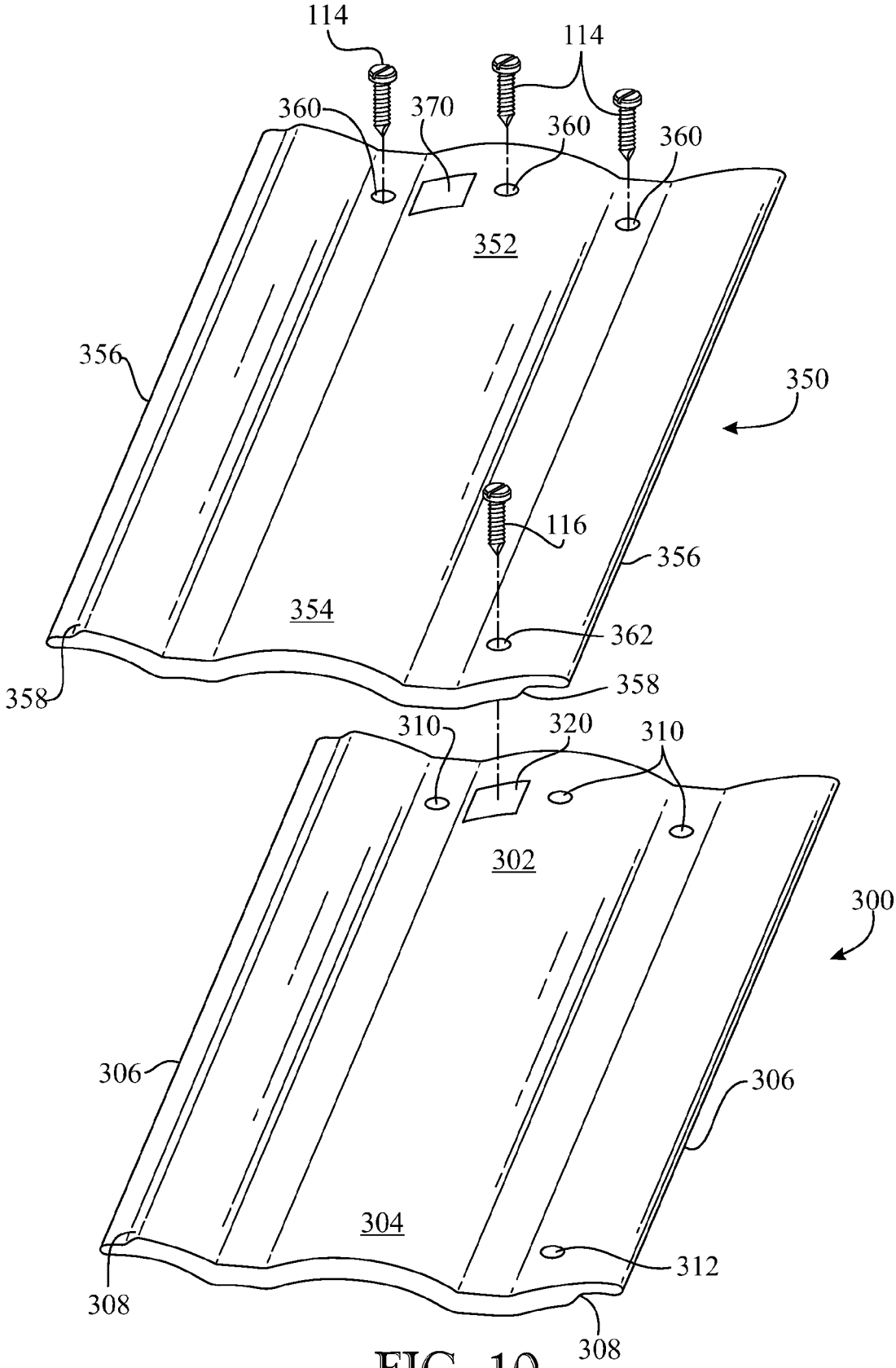
FIG. 10 presents an exploded perspective view of two low-profile Spanish style or double roll roofing tiles of the present invention in partial overlapping relation.

FIG. 10 shows an exemplary first low-profile Spanish style tile 300 and a second low-profile Spanish style tile 350 (alternately referred to as a double rolled tile) positioned in the same relation as shown in FIG. 8. First and second Spanish style tiles 300 and 350 include a protected end 302 and 352, an exposed end 304 and 354, side edges 306 and 356, formed lips 308 and 358, attachment holes 310 and 360, an anchoring panel 320 and 370, and an interlock hole 312 and 362. The system of the present invention is to be employed as set forth above to provide interlocking rows of tiles in side-by-side relation covering sections of roofing substrate.

Figure 11:
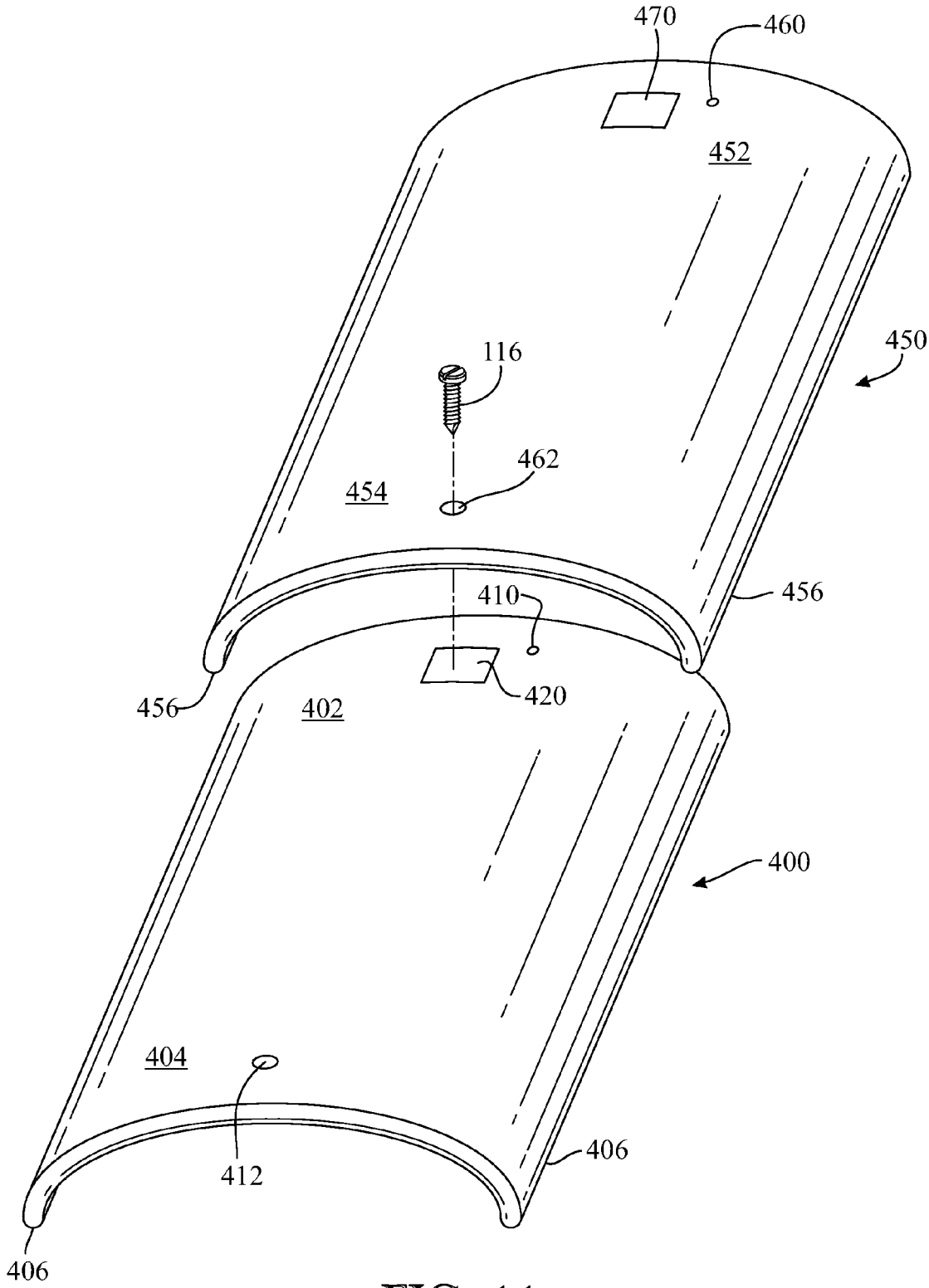
FIG. 11 presents an exploded perspective view of two curved ridge tiles of the present invention in partial overlapping relation.
Figure 12:
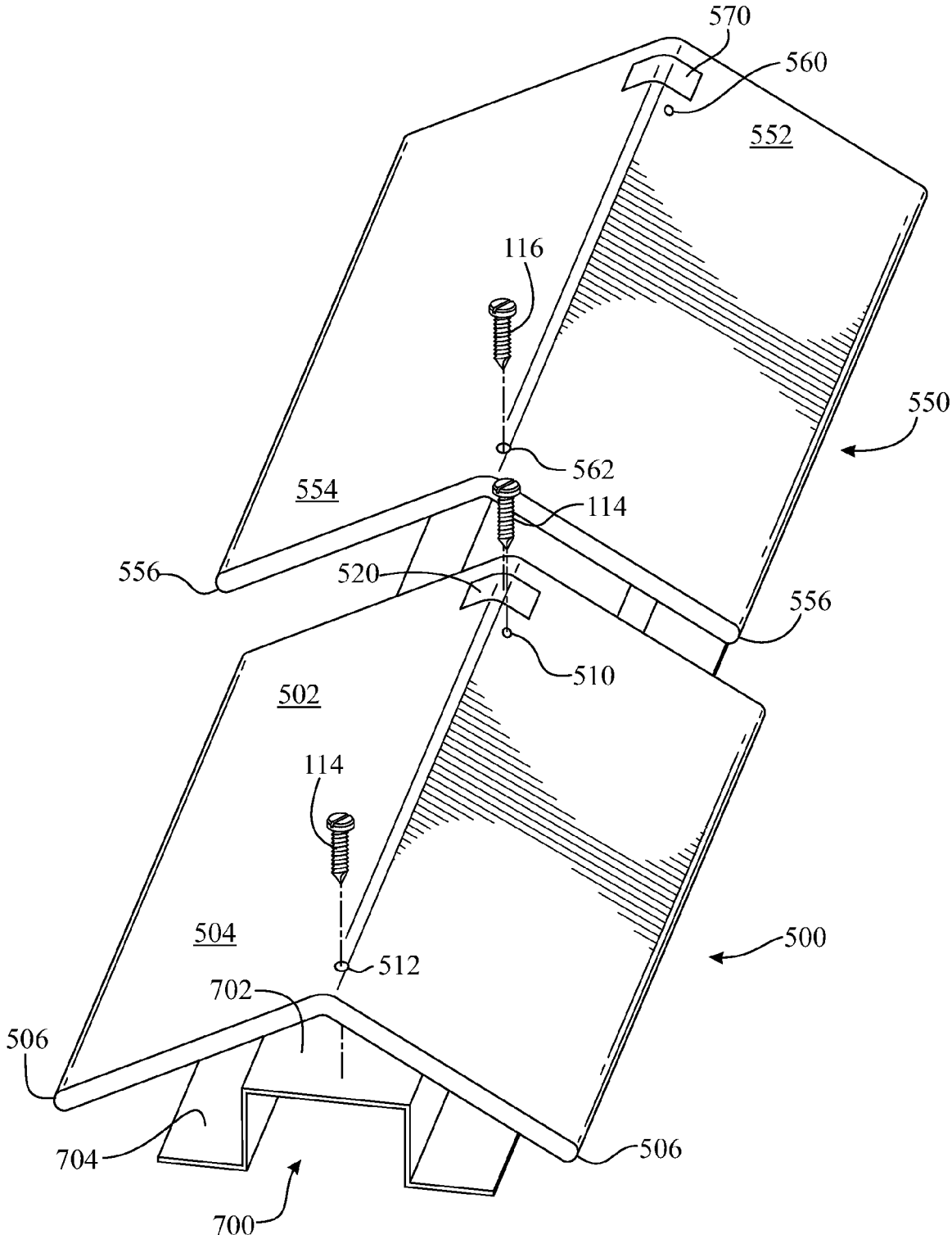
FIG. 12 presents an exploded perspective view of two angled ridge tiles of the present invention in partial overlapping relation.

Adjacent sections of roofing substrate, on a pitched roof, meet to form peaks, having a seam between uppermost rows of tiles on each of the sections. FIG. 11 shows an exemplary first curved ridge tile 400 and a second curved ridge tile 450, which are to be attached along a roof peak, by primary fastening means (not shown) driven through attachment holes 410 and into the substrate. First and second curved ridge tiles 400 and 450 include a protected end 402 and 452, an exposed end 404 and 454, side edges 406 and 456, attachment holes 410 and 460, an anchoring panel 420 and 470, and an interlock hole 412 and 462. The second curved ridge tile 450 partially overlaps the first curved ridge tile 400, as indicated in FIG. 11 and secondary fastening means, such as a interlock fastener 116, may be driven along the path indicated by the dotted line, through the interlock hole 462 in the second curved ridge tile 450 and into the anchoring panel 420 in the first curved ridge tile 400. Each of the ridge tiles is attached to the roofing substrate by primary fastening means and interlocked with an adjacent partially overlapped ridge tile by secondary fastening means. FIG. 12 shows a first angled ridge tile 500 and a second flat angled ridge roof tile 550 incorporating the features of the present invention, for attachment in the same manner as the first and second curved ridge tiles 400 and 450 shown in FIG. 11. FIG. 12 introduces a hip and ridge frame 700, formed providing a ridge tile assembly portion 702 and a roof securing flange 704. The hip and ridge frame 700 is secured to a roof along a ridgeline by inserting a series of mechanical fasteners (such as screws) through the roof securing flange 704 and into the roofing material. The angled ridge tiles 500, 550 are secured to the hip and ridge frame 700 via primary roofing screws 114 inserted through the attachment holes 510, 560 and into the ridge tile assembly portion 702. The angled ridge tiles 500, 550 are then secured to the adjacent tile 500 via an interlock fastener 116 inserted through the interlock holes 512, 562 and into the anchoring panel 520.

Figure 13:
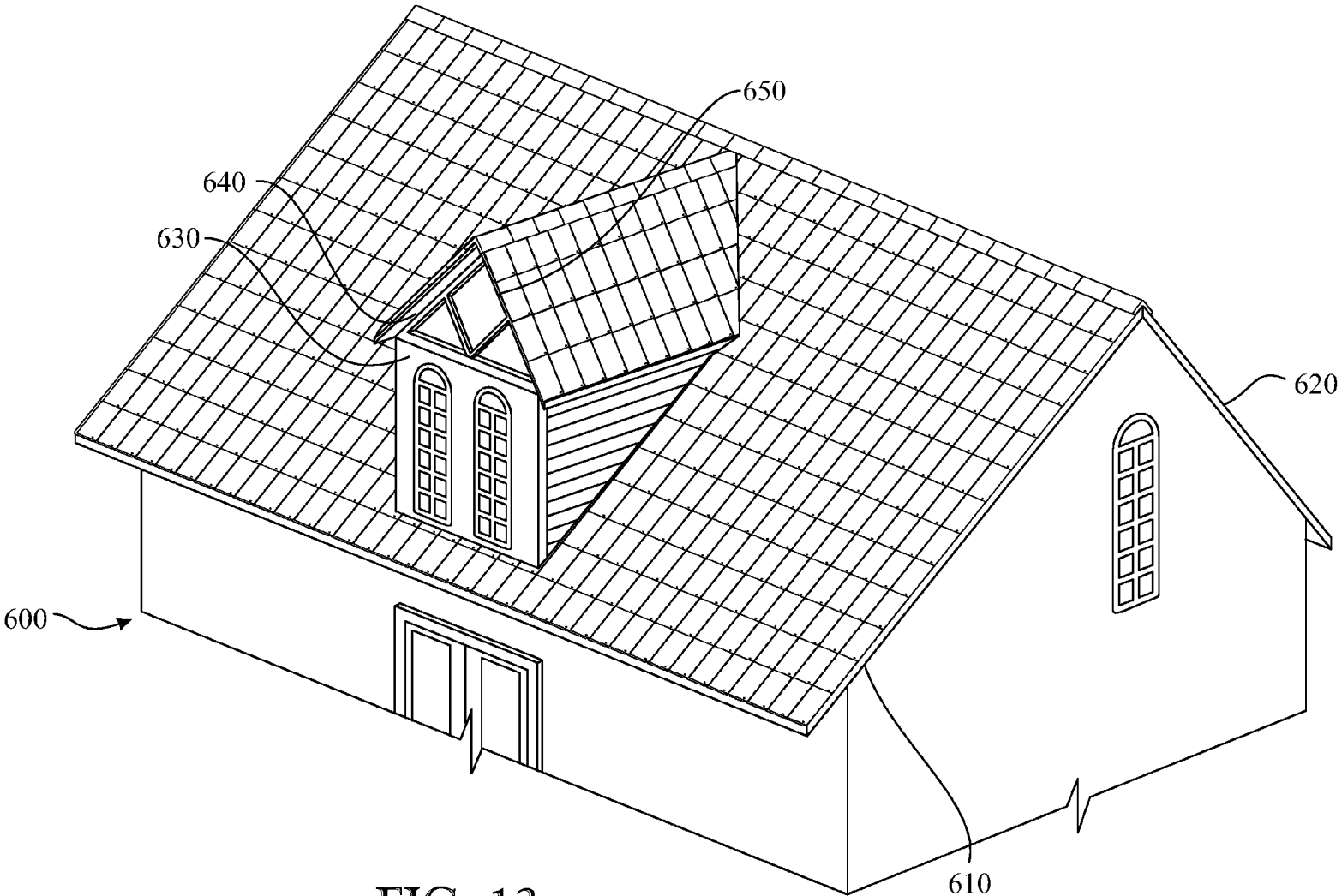
FIG. 13 presents a front perspective view of a building with roofing tiles of the present invention installed.

FIG. 13 shows a building 600 with a pitched roof occupying a front substrate section 610 and a rear substrate section 620. The front of the building also includes a dormer 630 with a pitched roof occupying a left substrate section 640 and a right substrate section 650. A plurality of interlocked rows of tiles in side-by-side relation covers each substrate section and a run of interlocked ridge tiles covers the seam at the junction of the front substrate section 610 and rear substrate section 620 and the seam at the junction of the left substrate section 640 and the right substrate section 650. The interlocking feature secures the exposed end 104, 204, 304, 404, 504 of each of the overlapping tiles and prevents movement of the tiles in high wind conditions, which movement tends to dislodge the tiles and expose the roof underlayment to weather damage and leaking. The heads of the interlock fasteners 116 may be colored to match the color of the roofing tiles, for aesthetic appeal and the anchoring panels may be likewise colored as well.

Figure 14:
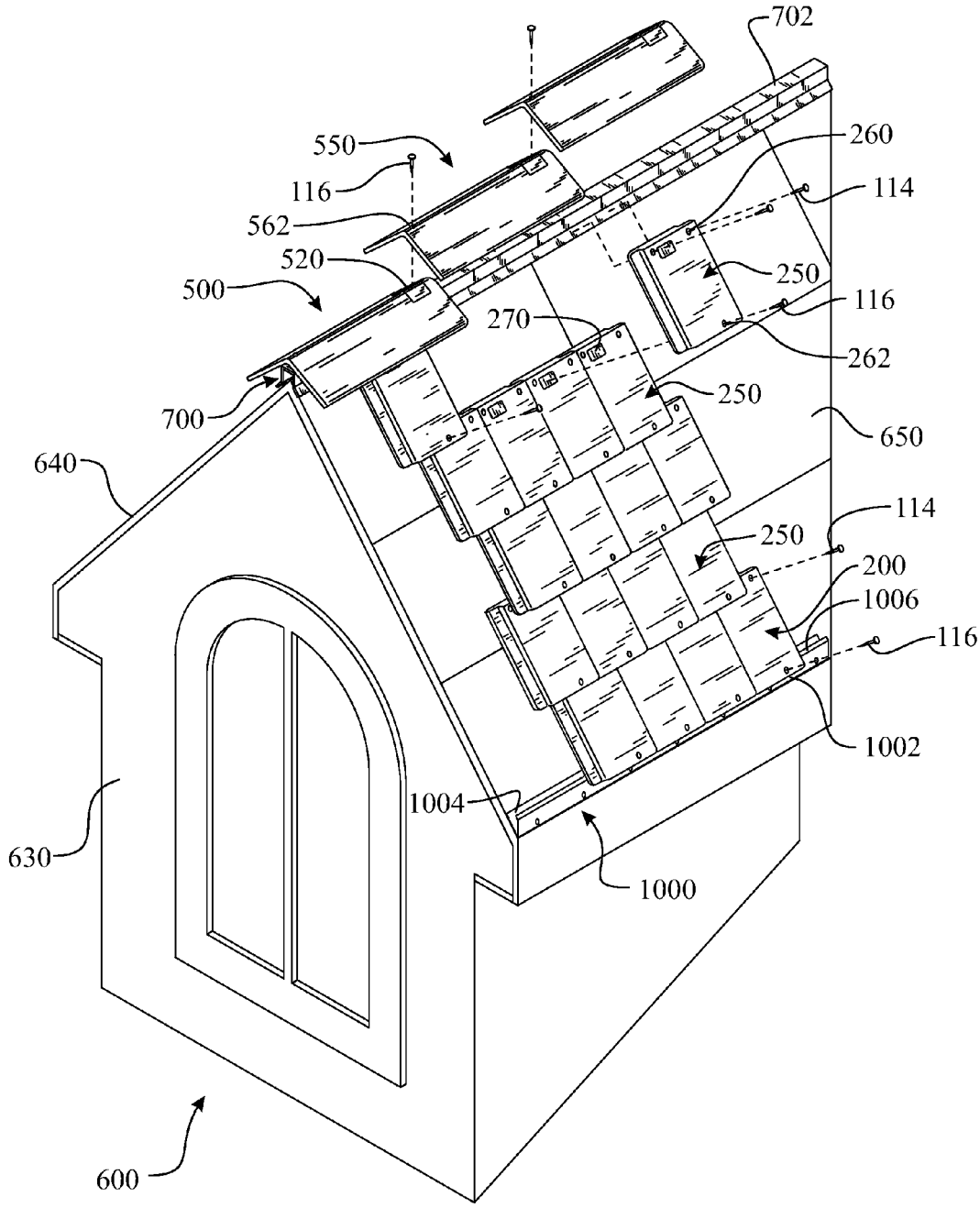
FIG. 14 presents a portion of a building illustrating details of an installation of flat roof tiles of the present invention.
Figure 15:
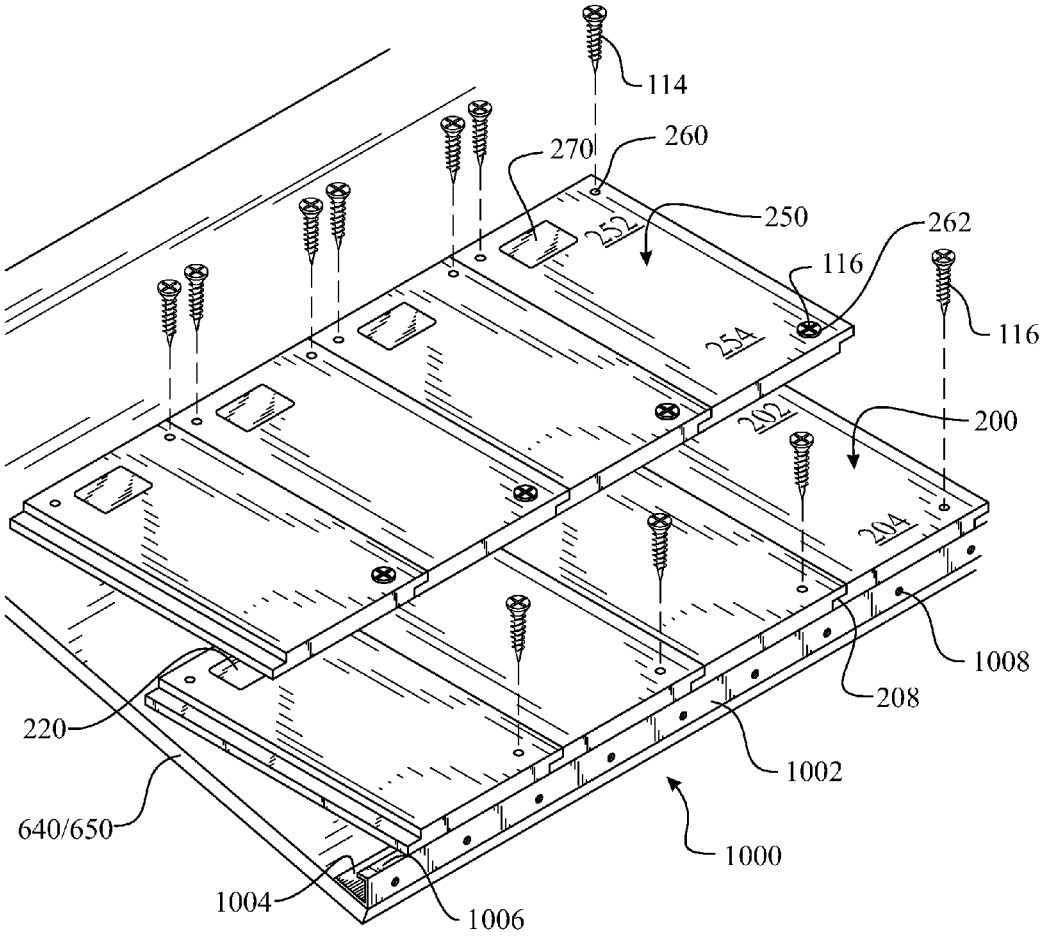
FIG. 15 presents an exemplary detailed view of FIG. 14, illustrating the installation of the starter course of tiles along a lower edge of the roof.

FIGS. 14 and 15 show an exemplary portion of a building 600 such as a dormer 630 having a pitched roof occupying a first substrate section 640, a second substrate section 650 and a roof tile system incorporating tiles fabricated in accordance with the present invention. The exemplary illustration utilizes flat tiles 200, 250, whereas it is understood that any tile form factor can incorporate the present invention. A flat tile eve closure assembly 1000 is provided having an eve fascia 1002, a roof mount flange 1004, and a tile coupling flange 1006 formed from a single sheet of material (preferably metal, such as anodized steel, aluminum, and the like). The flat tile eve closure assembly 1000 is attached along a lower edge of each of the roof substrates 640, 650 by inserting a series of fasteners through the roof mount flange 1004 and secured into the roof substrates 640, 650. A first row of tiles, referred to as a starter course, are positioned and attached to the roof via a plurality of fasteners. The lower edge of the flat roof tiles 200 are secured to the tile coupling flange 1006 via an interlocking fastener 116 and the upper edge of the flat roof tiles 200 are secured to the roof substrates 640, 650 via a plurality of standard tile fasteners 114. A series of rows of flat roof tiles 250 are then placed sequentially atop the upper portion of the flat roof tile 200, 250 of the previously installed row as illustrated. The second flat roof tiles 250 are secured to the roof substrate via primary roofing screws 114. The primary roofing screws 114 are inserted through attachment holes 260 of the protected end 252 and into the roof substrate 640, 650. The exposed end 254 of the second flat tile 250 is secured to the overlapped tile 200 via insertion of an interlock fastener 116 through the interlock hole 262 and into the respective anchoring panel 220, 270. This configuration secures the exposed end 254, which was previously left unsecured. A series of weep holes 1008 are provided through the eve fascia 1002, allowing for drainage of any rainfall. Adjacent tiles are assembled in an overlapping manner, having an interlock formed via mating formed lips 208, 258.

A series of ridge tiles 500, 550 are assembled along a roof ridgeline in a similar manner. The assembly of the ridge tiles 500, 550 was previously described via FIG. 12.

FIG. 15 shows an assembly view analogous to the assembly view of FIG. 12, utilizing roofing having a row of first low-profile Spanish style tiles 300, a plurality of rows of second low-profile Spanish style tiles 350, a first curved ridge tile 400, and plurality of second curved ridge tiles 450. Details of the tile to roof assembly were previously presented respective to FIG. 9. It is understood that the anchoring panel 320, 370 can be placed anywhere in registration with the respective interlock hole 362. The registration can be used to align the tiles or stagger the tiles. This is applicable to any tile configuration.

Figure 16:
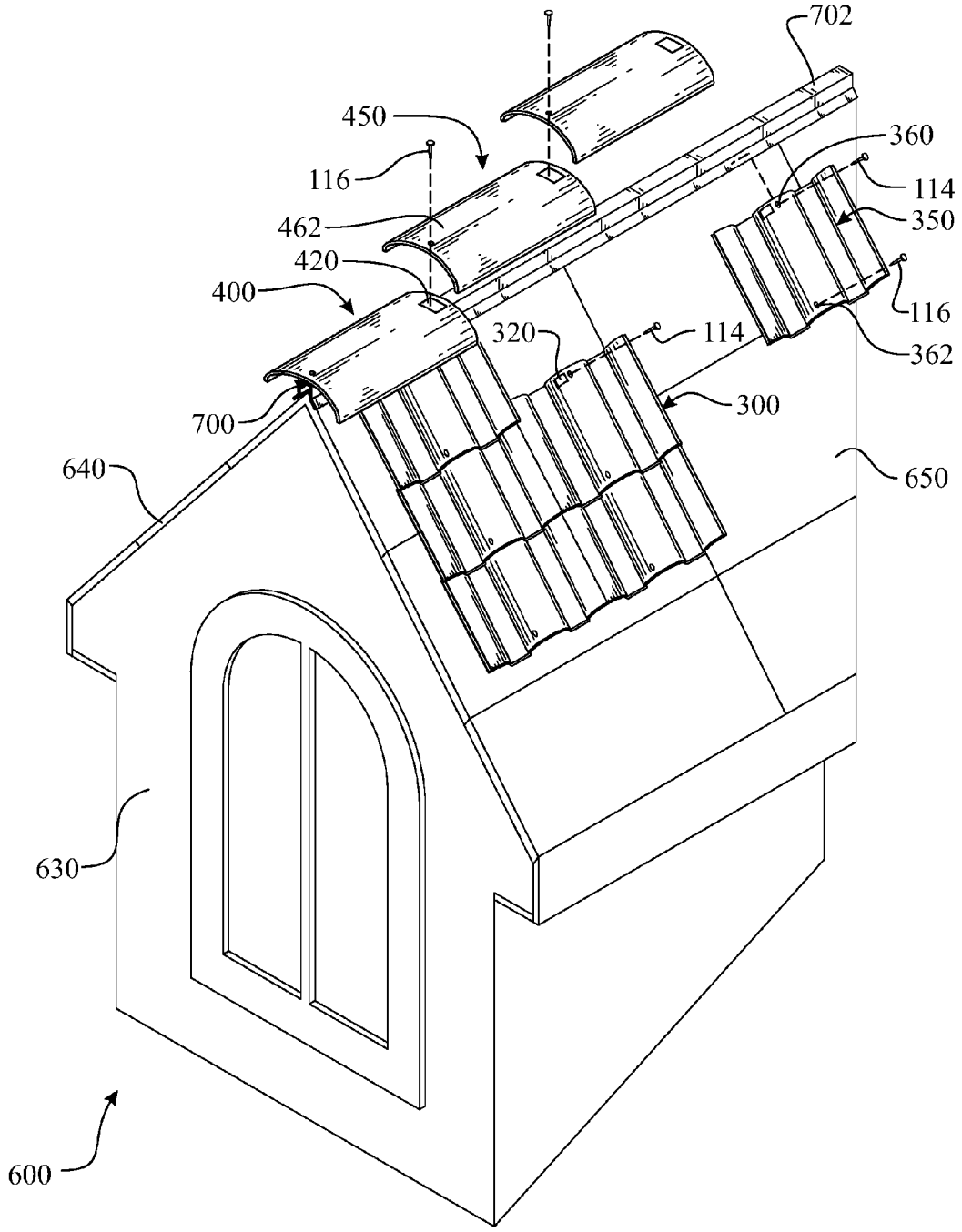
FIG. 16 presents a portion of a building illustrating details of an installation of low profile Spanish style roof tiles of the present invention.
Figure 17:
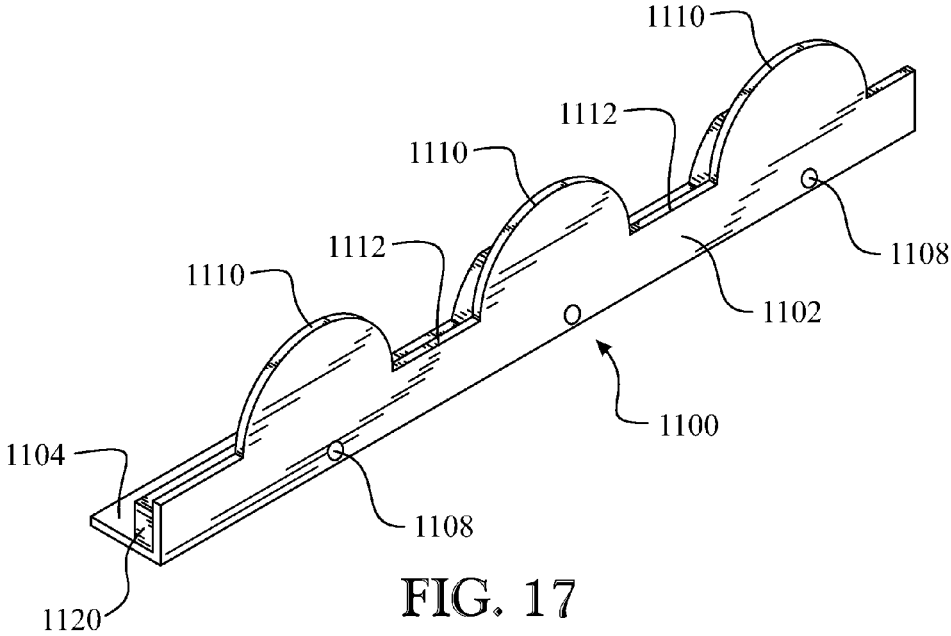
FIG. 17 presents an exemplary eve closure for use in conjunction with a barrel style roof tile.

The eve closures are provided in a variety of form factors, each respective to a specific tile form factor. FIGS. 16 through 22 present several exemplary embodiments and the unique features of each. FIGS. 16 and 17 present eve closures for barrel tiles, each being uniquely formed. A barrel tile eve closure assembly 1100 is formed by stamping and bending a piece of sheet metal creating an eve fascia 1102 and a roof mount flange 1104. The eve fascia 1102 provides a seal at the exposed end of the starter course of the roof tiles. The roof mount flange 1104 provides a means to attach the barrel tile eve closure assembly 1100 to the roof substrate. An eve closure backing member 1120 is attached to the barrel tile eve closure assembly 1100 adding rigidity and support. The eve closure backing member 1120 can be formed of a wood, plastic, fiberboard, composite, or any other weather resistant and corrosion resistant material. The eve fascia 1102 includes a curved interface section 1110 and a planar base interface section 1112 shaped to conform to the underside of the barrel shaped roof tile. A series of weep holes 1108 are provided along a fold line formed between the eve fascia 1102 and the roof mount flange 1104. The weep holes 1108 are drilled through both the eve fascia 1102 and the eve closure backing member 1120, providing a passageway for rainwater and other small undesirable matter to discharge. The illustrated form factor is designed for a barrel style roof tile, which has a smooth bottom surface, contouring to the top surface.

Figure 18:
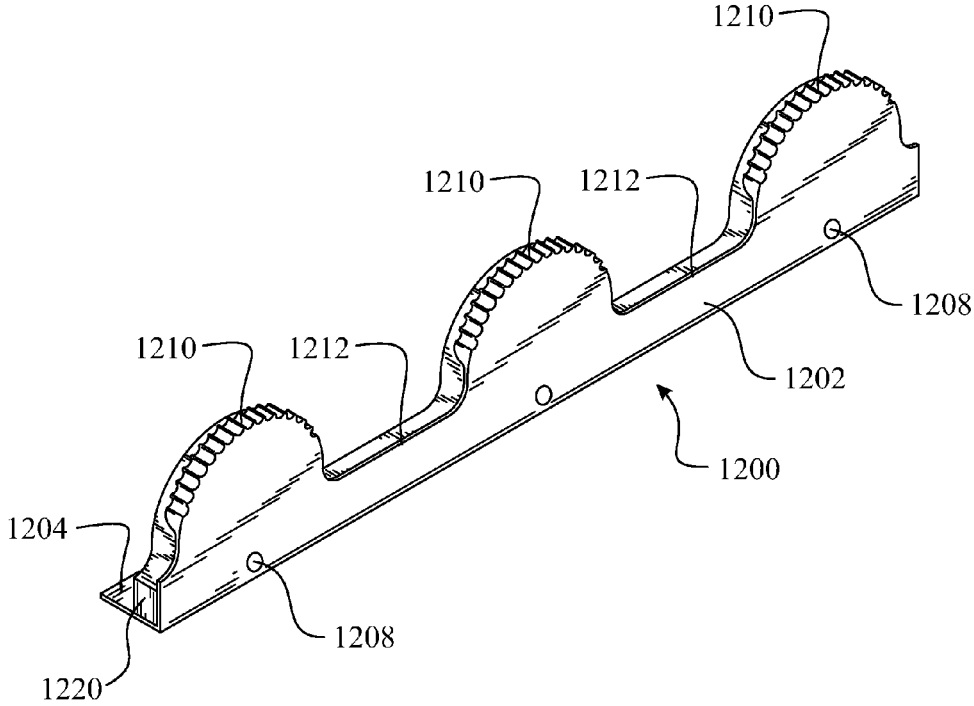
FIG. 18 presents an alternate exemplary eve closure for use in conjunction with a barrel style roof tile.

An alternate barrel tile eve closure assembly 1200, as illustrated in FIG. 18, is formed by stamping and bending a piece of sheet metal creating an eve fascia 1202 and a roof mount flange 1204 to be utilized as described above. An eve closure backing member 1220 is attached to the barrel tile eve closure assembly 1200 to add rigidity and support. The eve fascia 1202 includes a curved interface section 1210 and a planar base interface section 1212 shaped to conform to the underside of the barrel shaped roof tile. Additionally, sheet metal is crimped and formed to create the curved interface section 1210, allowing attachment of the roof tile to the curved interface section 1210 via a threaded mechanical fastener. A series of weep holes 1208 are provided, similar to the weep holes 1108 previously disclosed. The barrel tile eve closure assembly 1200 is designed for a roof tile that has a smooth bottom surface, contouring to the top surface.

Figure 19:
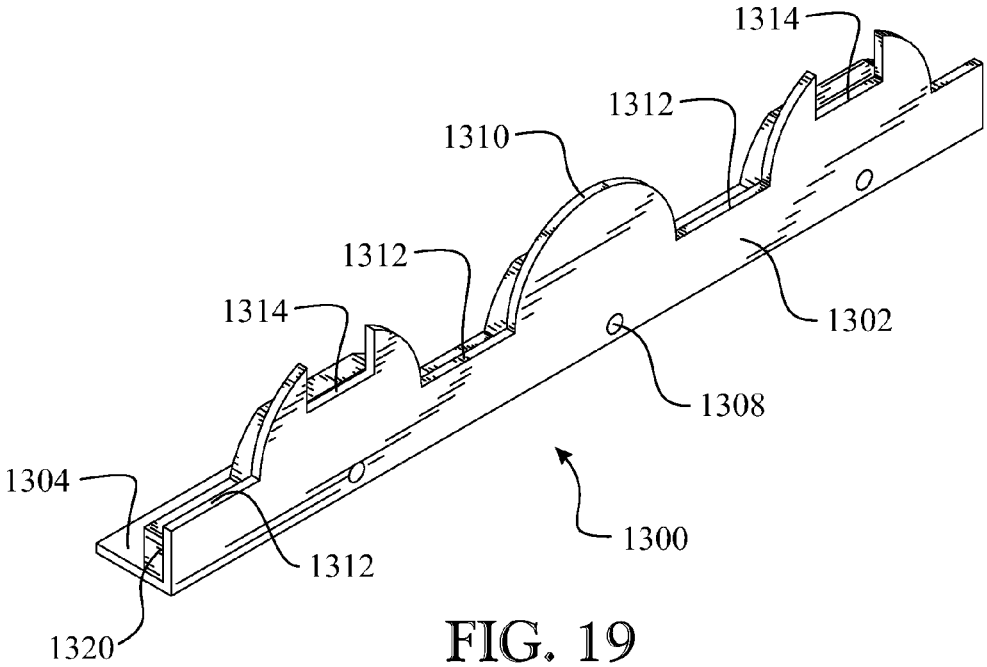
FIG. 19 presents an exemplary eve closure for use in conjunction with a low profile Spanish style roof tile.
Figure 20:
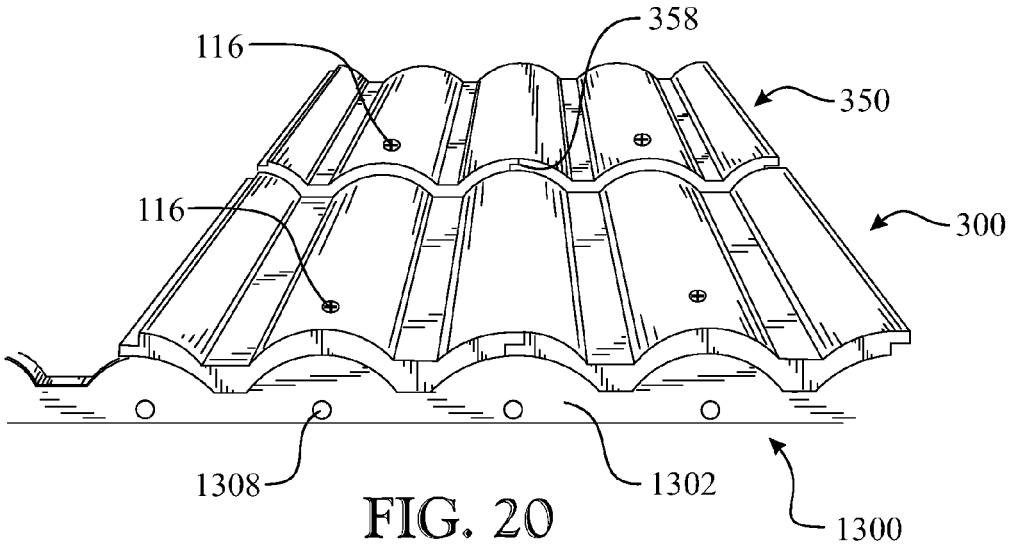
FIG. 20 presents a perspective end view of a series of low profile Spanish style roof tiles, including the starter course being installed about the eve closure.
Figure 21:
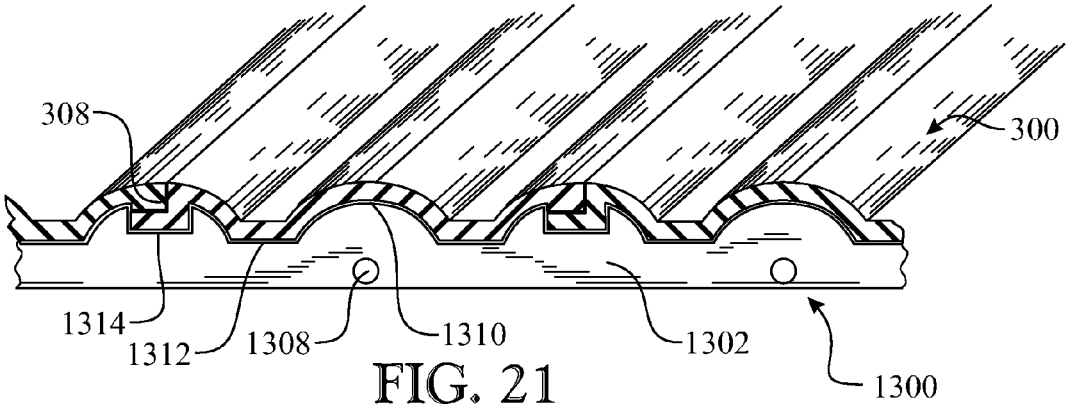
FIG. 21 presents a sectioned view of the of low profile Spanish style roof tiles of FIG. 20, detailing the tile—eve closure interface.

A barrel tile eve closure assembly 1300 is formed for use in conjunction with a roof tile having a raised rim about a perimeter of the bottom side of a roof tile (similar to raised underside rim 180 of FIG. 23), such as for a first low-profile Spanish style tile 300 as illustrated in FIGS. 19 through 21. The barrel tile eve closure assembly 1300 is formed similarly to the barrel tile eve closure assembly 1100, providing an eve fascia 1302 and a roof mount flange 1304 to be utilized in a manner as described above. An eve closure backing member 1320 provides support and rigidity between the eve fascia 1302 and the roof mount flange 1304. The eve fascia 1302 is formed having a curved interface section 1310 and a planar base interface section 1312 as previously described, with the inclusion of a rim receiving cavity 1314 formed in the center of every other curved interface section 1310. The rim receiving cavity 1314 provides clearance for the raised rim about a perimeter of the bottom side of a roof tile as shown as a portion of the formed lip 308 in the cross sectional illustration of the first low-profile Spanish style tile 300 of FIG. 21. The raised rim runs along the formed lip 308, thus requiring a clearance in the barrel tile eve closure assembly 1300. The rim receiving cavity 1314 provides clearance for the raised rim, allowing the roof tile 300 to be seated flush along the upper edge of the eve fascia 1302. A series of weep holes 1308 are provided along a fold line formed between the eve fascia 1302 and the roof mount flange 1304. An interlock fastener 116 is inserted through an interlock hole 312 (FIG. 9) and into the eve closure backing member 1320.

Figure 22:
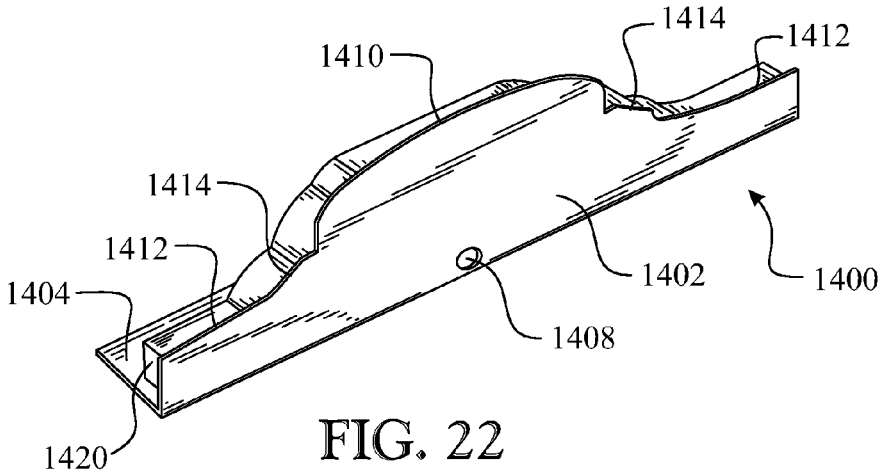
FIG. 22 presents an exemplary eve closure for use in conjunction with a double curve style roof tile.
Figure 23:
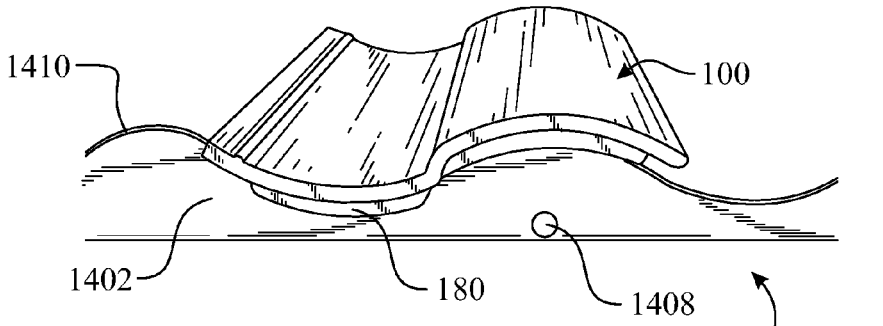
FIG. 23 presents a perspective end view of a low profile Spanish style roof tile placed onto the eve closure.

A double curve eve closure assembly 1400 is also formed for use in conjunction with a roof tile having a raised underside rim 180 formed about a perimeter of the bottom side of a double curved roof tile 100, as illustrated in FIGS. 22 and 23. The double curve eve closure assembly 1400 is formed similarly to the barrel tile eve closure assembly 1100, providing an eve fascia 1402 and a roof mount flange 1404 to be utilized in a manner as described above. The eve fascia 1402 is formed having a curved peak interface section 1410 and a recessed base interface section 1412 as previously described, with the inclusion of a rim receiving clearance 1414 formed about the sides of the curved peak interface section 1410. An eve closure backing member 1420 is provides support and rigidity between the eve fascia 1402 and the roof mount flange 1404. The rim receiving clearance 1414 provides clearance for the raised underside rim 180 about a perimeter of the bottom side of a roof tile as shown. The raised underside rim 180 runs along the formed lip 108, thus requiring a clearance in the double curve eve closure assembly 1400. The rim receiving clearance 1414 provides clearance for the raised rim, allowing the roof tile 100 to be seated flush along the upper edge of the eve fascia 1402, as shown. A series of weep holes 1408 are provided along a fold line formed between the eve fascia 1402 and the roof mount flange 1404.

While the preferred embodiments of the invention have been described above, it will be recognized and understood that various modifications can be made in the invention and the appended claims are intended to cover all such modifications which may fall within the spirit and scope of the invention.

What is claimed is:

1. A rigid roofing tile, said tile comprising:

a roofing tile by having an upper surface and a lower surface separated by a peripheral edge defined by a protected end, an exposed end, and two side edges;

said tile having at least one attachment hole passing therethrough, said at least one attachment hole being located proximate to said protected end, wherein each attachment hole is provided for passing a primary fastener therethrough;

said tile having at least one anchoring panel being fabricated of a material compatible for receiving an anchoring panel fastener, said at least one anchoring panel having a maximum thickness equal to a thickness of a section of said tile proximate said anchoring panel;

wherein said at least one anchoring panel is affixed, proximate to said protected end, by an engagement interface; and said tile having at least one interlock hole formed therethrough, said at least one interlock hole being located proximate to said exposed end and positioned to register with at least one anchoring panel of a tile when placed onto a roof, wherein said at least one interlock hole is provided for passing said anchoring panel fastener therethrough enabling said anchoring panel fastener to engage with said and secure to a respective anchoring panel.

2. The roofing tile of claim 1, wherein said tile is fabricated of at least one of:

a) a concrete based material, b) a plastic based material, and c) a clay based material.

3. The roofing system of claim 1, wherein said anchoring panel is formed of at least one of:

a) a plastic material, b) a composite material, c) a synthetic material, d) a copolymer based material, e) a semi-crystalline polymer based material, f) a resin based material, and g) Polyoxymethylene.

4. The roofing system of claim 1, wherein said anchoring panel incorporates a tile engaging feature comprising at least one of:

a) a canted perimeter facet,
b) a groove formed in a perimeter facet of said anchor panel,
c) a plurality of finger webs formed on said perimeter facet of said anchor panel,
d) a flange formed on said perimeter facet,
e) a flange having a series of wells formed on said perimeter facet, and
f) a flange having a series of apertures formed on said perimeter facet.

5. The roofing system of claim 4, wherein said anchoring panel is formed of at least one of:
a) a plastic material,
b) a composite material,
c) a synthetic material,
d) a copolymer based material,
e) a semi-crystalline polymer based material,
f) a resin based material, and
g) Polyoxymethylene.

6. A roofing tile system of partially overlapping rows of tiles in a side-by-side and row-by-row relation, on a substrate of a pitched roof, said system comprising:
a plurality of weatherproof tiles, a plurality of standard tile fasteners, and a plurality of interlocking fasteners;
each of said tiles having an upper surface and a lower surface separated by a peripheral edge defined by a protected end, an exposed end, and two side edges;
each of said tiles having at least one attachment hole, for receiving standard tile fasteners, said attachment holes being located proximate to said protected end;
a majority of said tiles having at least one anchoring panel, each anchoring panel being provided for receiving at least one interlocking fastener;
said anchoring panels being affixed, proximate to said protected end, by engagement interface;
a majority of said tiles having at least one interlock hole, said interlock holes being located proximate to said exposed end and positioned to register with the at least one anchoring panel of a tile in said overlapped row of tiles;
said standard tile fasteners being driven through said attachment holes in a first row and second row of tiles and into said substrate to attach said first and second rows of tiles, in side-by-side relation; said second row of tiles partially overlapping said first row of tiles;
said interlocking fasteners being driven through said interlock holes in said second row of tiles into said anchoring panels in said first row of tiles for interlocking said first and second rows of tiles; and
an eve closure having a roof mounting flange and a tile coupling edge, wherein the tile coupling edge is contoured to a profile of an underside of said tiles;
wherein said first row of tiles is secured to the tile coupling edge of the eve closure.

7. The roofing tile system of claim 6, wherein:
said standard tile fasteners consist of self threading screws; and
said interlocking fasteners consist of self threading screws.

8. The roofing system of claim 6, wherein said anchoring panel is formed of at least one of:
a) a plastic material,
b) a composite material,
c) a synthetic material,
d) a copolymer based material,
e) a semi-crystalline polymer based material,
f) a resin based material, and
g) Polyoxymethylene.

9. The roofing tile system of claim 6, wherein:
each of said roofing tiles includes an aperture sized to receive said anchoring panel;
said anchoring panel includes a perimeter facet and is received within said aperture, with said perimeter facet adjacent to an inner aspect of said aperture.

10. The roofing the system of claim 9, wherein:
said engagement interface includes a groove, formed in said perimeter facet and a tongue formed on the inner aspect of said aperture;
said tongue is received within said groove to retain said anchoring panel on said tile.

11. The roofing the system of claim 9, wherein:
said engagement means includes a plurality of finger webs formed on said perimeter facet and a plurality of corresponding ridges formed on the inner aspect of said aperture;
said finger webs and said ridges inter-engage to retain said anchoring panel on said tile.

12. The roofing tile system of claim 9, wherein:
said engagement interface includes a flange formed on said perimeter facet and a channel formed on the inner aspect of said aperture;
said flange having a plurality of wells about said flange;
said channel having a plurality of bosses about said channel;
said flange being received within said channel and said bosses being received within said well for retaining said anchoring panel on said tile.

13. The roofing tile system of claim 9, wherein:
said inner aspect of said aperture is canted to taper said aperture and said perimeter facet is canted to correspond with said tapered aperture, for supporting said anchoring panel within said aperture and said engagement interface includes at least one of:
a) said anchoring panel having a shape wherein said panel shape is at least partially entrapped within said roofing tile,
b) an adhesive applied to said perimeter facet to said inner aspect of said aperture, for retaining said anchoring panel on said tile.

14. A roofing tile system on a substrate of a pitched roof, said system comprising:
a plurality of ridge tiles, each of said ridge tiles having a protected end, an exposed end, and two side edges;
a plurality of interlock fasteners;
a majority of said ridge tiles having at least one ridge tile anchoring panel, for receiving at least one of said interlock fasteners;
said anchoring panels being affixed, proximate to said protected end, by engagement interface;
a majority of said ridge tiles having an interlock hole;
said interlock hole being located proximate to said exposed end and positioned to register with the at least one ridge tile anchoring panel of a ridge tile in said overlapped row of tiles;
said interlocking fasteners being driven through said interlock holes in an overlapping ridge tile into said ridge tile anchoring panels in a respective overlapped ridge tile for interlocking said overlapping ridge tile and said respective overlapped ridge tile.

15. The roofing tile system of claim 14, said system further comprising:
a plurality of roof tiles;
a plurality of standard tile fasteners;
each of said roof tiles having a protected end, an exposed end, and two side edges;
each of said roof tiles having at least one attachment hole, for receiving standard tile fasteners;

said attachment holes being located proximate to said protected end;

a majority of said roof tiles having at least one roof tile anchoring panel, for receiving interlocking fasteners;

said roof tile anchoring panels being affixed, proximate to said protected end, by engagement interface;

a majority of said roof tiles having at least one interlock hole;

said interlock holes being located proximate to said exposed end and positioned to register with at least one roof tile anchoring panel of a roof tile in said overlapped row of roof tiles;

driving said standard tile fasteners through said attachment holes in a first row and second row of roof tiles and into said substrate to attach said first and second rows of tiles; said second row of roof tiles partially overlapping said first row of roof tiles; and driving said interlocking fasteners through said interlock holes in said second row of tiles into said anchoring panels in said first row of tiles for interlocking said first and second rows of tiles.

16. The roofing tile system of claim 15, wherein:

said standard tile fastener consist of self threading screws; and said interlocking fasteners consist of self threading screws.

17. The roofing tile system of claim 15, wherein said ridge tile anchoring panel and said roof tile anchoring panel is formed of at least one of:

a) a plastic material, b) a composite material, c) a synthetic material, d) a copolymer based material, e) a semi-crystalline polymer based material, f) a resin based material, and g) Polyoxymethylene.

18. The roofing tile system of claim 15, the system further comprising:

an eve closure having a roof mounting flange and a tile coupling edge, wherein the tile coupling edge is contoured to a profile of an underside of said tiles;

wherein said first row of tiles is secured to the tile coupling edge of the eve closure.

19. The roofing tile system of claim 18, wherein said first row of tiles is secured to the tile coupling edge of the eve closure via a fastener inserted through the at least one interlock hole.

20. The roofing tile system of claim 14, wherein said ridge tile anchoring panel is formed of at least one of:

a) a plastic material, b) a composite material, c) a synthetic material, d) a copolymer based material, e) a semi-crystalline polymer based material, f) a resin based material, and g) Polyoxymethylene.

21. The roofing system of claim 14, wherein said ridge tile anchoring panel incorporates a tile engaging feature comprising at least one of:

a) a canted perimeter facet, b) a groove formed in a perimeter facet of said anchor panel, c) a plurality of finger webs formed on said perimeter facet of said anchor panel, d) a flange formed on said perimeter facet, e) a flange having a series of wells formed on said perimeter facet, and f) a flange having a series of apertures formed on said perimeter facet.

* * * * *